United States Patent [19]

Bourbon

[11] 4,170,423

[45] Oct. 9, 1979

[54] SYSTEM FOR THE HOUSING AND DISPLAY OF PLANE DATA CARRIERS

[75] Inventor: Jean Bourbon, Saint-Lupicin, France

[73] Assignee: Societe Anonyme: Tournerie du Jura-Ets A. Bourbon & Fils, France

[21] Appl. No.: 891,522

[22] Filed: Mar. 30, 1978

[30] Foreign Application Priority Data

Mar. 25, 1977 [FR] France ..... 77 10145

[51] Int. Cl.[2] ..... B42F 13/00

[52] U.S. Cl. ..... 402/70; 402/76; 402/502

[58] Field of Search ..... 402/76, 75, 502, 70; 40/530, 376

[56] References Cited

U.S. PATENT DOCUMENTS

| | | | |
|---|---|---|---|
| 2,080,995 | 5/1937 | Baker et al. | 40/376 |
| 2,156,551 | 5/1939 | Stark | 40/376 |
| 2,363,574 | 11/1944 | Cowan | 40/376 X |
| 2,612,168 | 9/1952 | Stark | 40/376 |
| 3,318,311 | 5/1967 | Gressette et al. | 40/376 X |

*Primary Examiner*—Robert L. Spicer, Jr.

*Attorney, Agent, or Firm*—Poms, Smith, Lande & Rose

[57] ABSTRACT

The invention relates to a system for the housing and display of plane data carriers such as cards composed of a casing comprising a box 1 supporting, by means of an axis X–X' parallel to its base 2, a pivoting lid 4 whose inner face comprises a pivot 8 for stacking the cards 13 which can be displayed from a starting position of alignment defined by stop means 6. This system is applied to the housing and to the display of cards carrying didactic information.

8 Claims, 8 Drawing Figures f1
f2
f3
P1
P2
x
x'
1
2
3
4
5
6
7
8
9
10
11
12
13

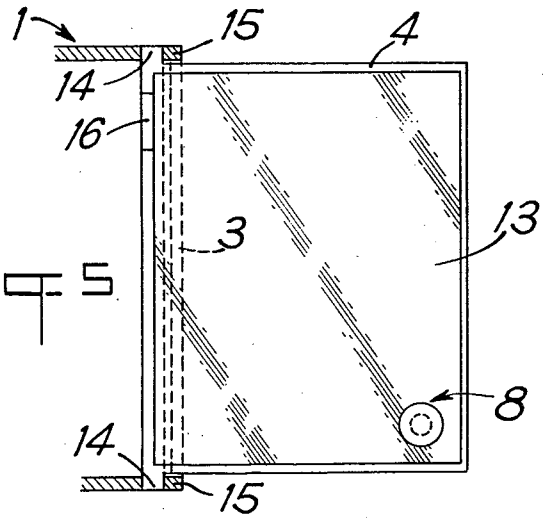
FIG. 5
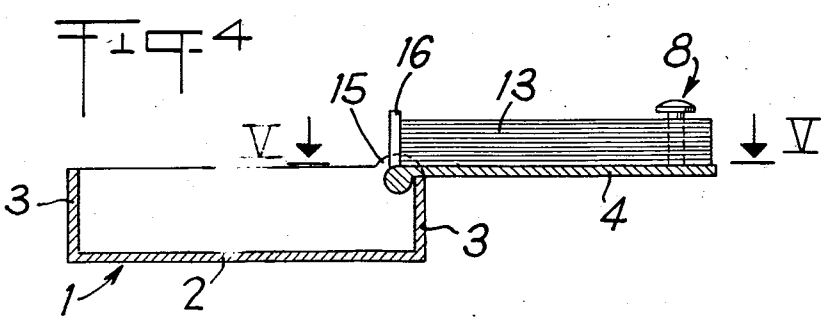
FIG. 4
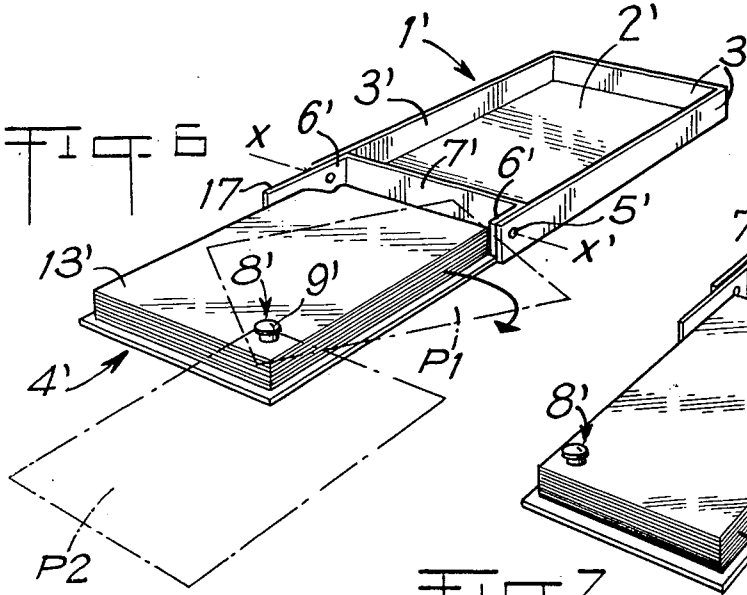
FIG. 6
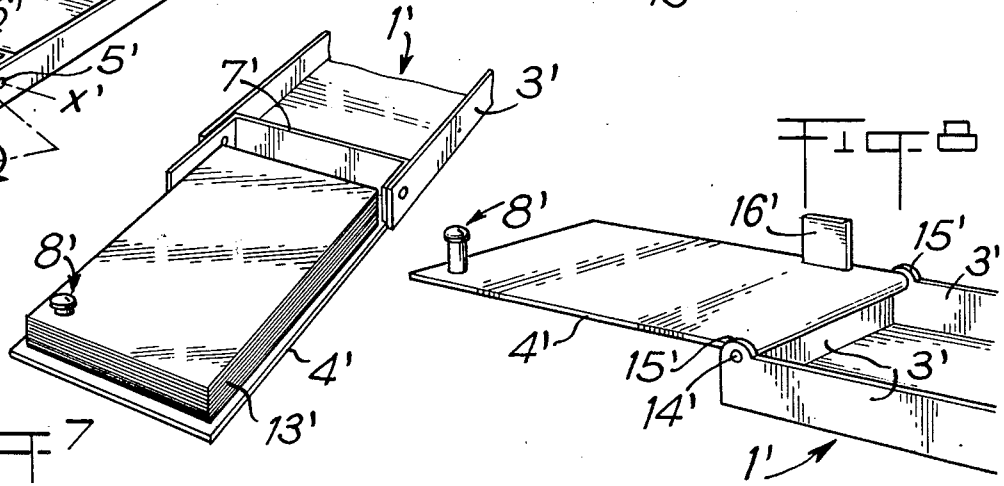
FIG. 7
FIG. 8

SYSTEM FOR THE HOUSING AND DISPLAY OF PLANE DATA CARRIERS

The present invention relates to the technical field of data consultation, the data being shown on plane data carriers such as cards, panels, etc.

In order to help the consultation, it is known to mount these cards in superimposed manner on a single axis passing through them, so as to form, in a way, a pivot on which the cards are stacked in decks and which makes it possible to display them in fan order by relatively pivoting each one in its own plane. Such display and consultation systems have the disadvantage of giving no protection to the cards which are then subjected to deteriorations and damages, which will rapidly reduce the quality of the service expected from the said cards.

In order to overcome this disadvantage, it has been proposed to associate the cards to a support carrying the axis or pivot which passes through them and, having a specific evolute surface, the said support is able to enclose the cards, and to constitute a sort of protective casing. Such a support is generally made from a flexible or semi-rigid material and composed of panels or flaps hinged so as to be easily freed from the deck of aligned cards or to be brought so as to enclose the said deck of cards outside consultation periods. Such a system is not satisfactory because the support does not afford protection to all the cards placed in decks on all sides, unless it is constituted in a complex manner which requires, for opening or closing, successive operations in a predetermined order, which does not encourage rapid consultation.

In order to solve this problem, it has also been proposed to mount the card inside a casing made up in two molded halves, assembled by means of a pivoting joint which plays a first part as a relative connection and pivoting member between the two halves of the casing and a second part as support and pivoting axis for the cards stacked through said pivot whilst remaining inside the casing when the two halves thereof are closed. With such a design, it is possible to open relatively the two halves of the casing by a pivoting movement in two parallel planes, and so to get access to the cards, which are thus made accessible over one part of their surface.

Although the double purpose of consultation and protection of the cards is reached with such a system, it is to be noted that this design has the disadvantage of necessitating the use of a casing in two complementary halves, each half being provided with a tubular member which can fit in and is complementary to that of the other half of the casing, so as to constitute together the pivoting joint which, forms on the one hand, the pivoting axis of the two halves of the casing and, on the other hand, the supporting axis of the cards. Such a requirement necessarily implies the use of moulds of a very high precision in order to obtain a casing in two halves, each one of which has half a tubular pivot with very precise dimensional characteristics, with in addition the possibility of being at least partly deformable, in order to be assembled, by at least partial axial engagement, with the complementary half-pivot of the other half of the casing. Products manufactured according to such exacting requirements are very expensive to produce and so, can only be put on the market at a high selling price, which therefore limits the size of the market which could be expected for such goods.

Another disadvantage of the aforesaid device resides in the fact that the positioning of cards raises a delicate problem in that all the cards should normally be stacked in one half of the casing on the corresponding half of the tubular pivot, so that the fitting of this half of the pivot into its complementary half situated in the other half of the casing can only be effected by appoximated relative positioning, on account of the complete absence of visibility necessary to judge the co-axial alignment of the two halves of the pivot and also to judge whether, during this operation, one or more cards have not been moved comparatively out of position, to the point of opposing the interpenetration or cooperation of the two complementary half-pivots.

It is the object of the invention to overcome the aforesaid disadvantages by creating a new casing for the protection and consultation of cards carrying information, said casing having the advantage of being produced at very low cost, of giving total protection to the cards, and of allowing rapid and handy consultation of each card over the largest surface of use thereof, and also of offering a possibility to position the cards, to remove them or to change their relative position without any risk of damage.

According to the invention, the protection and consultation casing for stacked data carriers is characterized by a box, supporting by means of a pivoting axis parallel to its base, a pivoting lid whose inner face comprises, on the one hand, a pivot for stacking cards which can be displayed in fan order and, on the other hand, stop means for aligning the cards one in relation to the other and to the said lid.

The invention will be more readily understood on reading the following description with reference to the accompanying drawings, in which:

FIG. 4 is a perspective view showing another embodiment of the object according to FIG. 1.

FIG. 5 is a partly sectional plan view along line V—V of FIG. 4.

FIG. 6 is a perspective view showing another embodiment of the object of the invention.

FIG. 7 is a perspective view showing a variant of embodiment of the object according to FIG. 6.

FIG. 8 is a perspective view showing another embodiment of the object according to FIG. 6 and comparable to the example given with reference to FIGS. 4 and 5.

Figures 1, 2, 3:
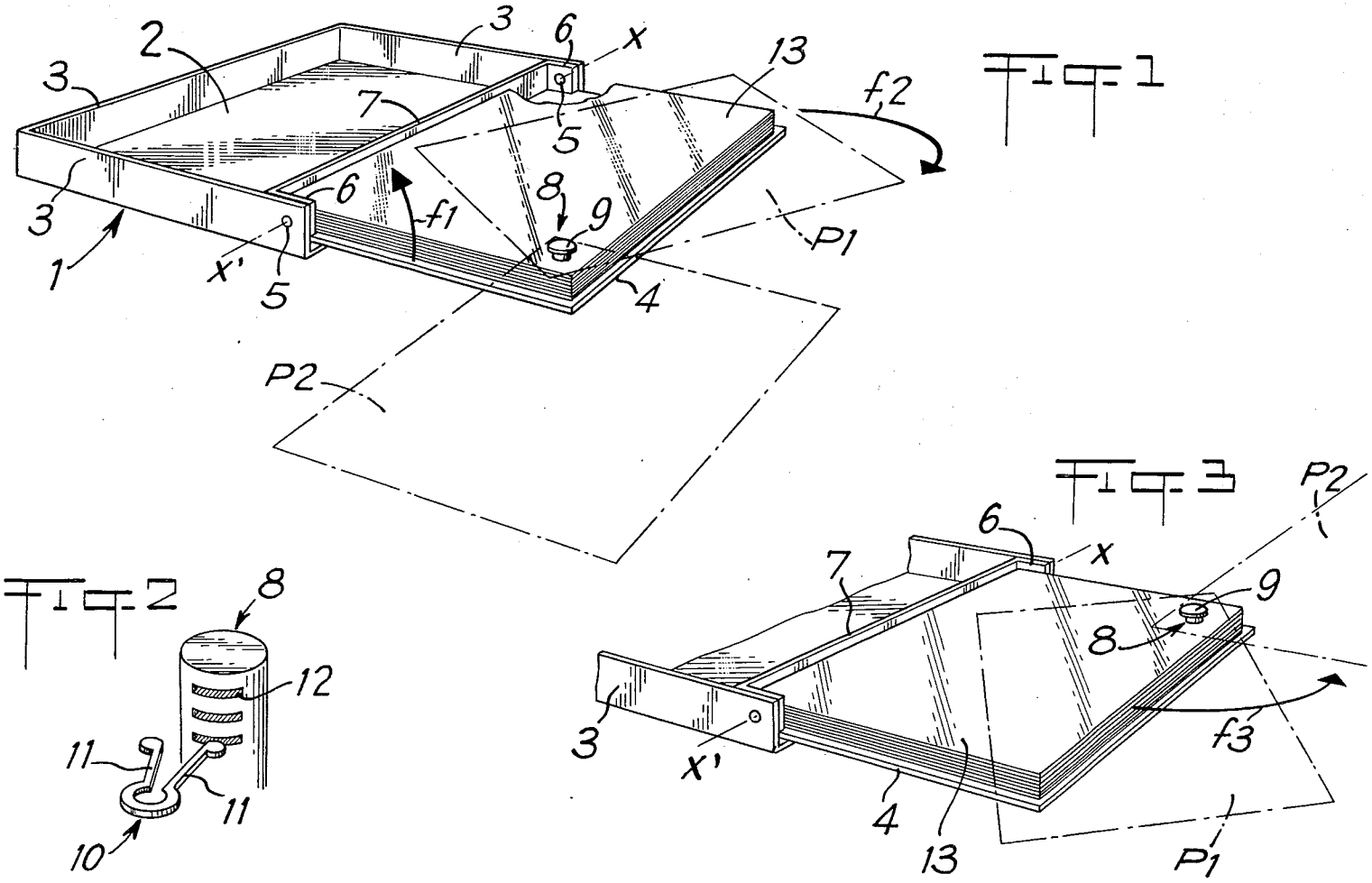
FIG. 1 is a perspective view, partly torn, of the object of the invention.
FIG. 2 is a partial perspective showing a detail of embodiment of one of the elements constituting the object of the invention.
FIG. 3 is a perspective view showing a variant embodiment of the object of the invention.

According to the embodiment shown in FIG. 1, the housing according to the invention is in the form of a box 1, parallepipedic in shape, very small in height, comprising a base 2 from which arise perpendicular vertical sides 3. The sides 3 only cover three edges of the base 2 and, in particular the two small parallel edges and one of the large perpendicular edges, the other large edge of the base 2 being, in this example, without a side 3. The box 1 is connected with a lid 4 by means of geometrical pivoting axis X–X′ parallel to the base 2. In the present embodiment, the pivoting connection according to axis X–X′ between the box 1 and the lid 4 is ensured by axes 5 passing through the small sides 3 close to the missing longitudinal side of the base 1, and by tabs 6 provided on the lid 4. Advantageously, tabs 6 are preferably interconnected by means of an edge plate 7 extending along the large edge of the lid 4 corresponding to the pivoting axis X–X' so as to constitute, after closure of said lid over the box 1, the missing second large side 3 of the latter.

The axis 5 may be formed by removable independent elements or else by studs, lugs or the likes, presented either by the tabs 6, or by the small sides 3 of the box 1. The position is determined so that, in the open position, the lid 4 is situated substantially in the plane of the base 2 of the box 1, whereas in the closed position, after pivoting in the direction of arrow $f_1$, the said lid then extends parallel to the base 2 substantially in the plane of the upper edges of the sides 3. Although this is not shown, it is possible to provide between the box 1 and the lid 4, means for immobilization in the closed position, such as means with elastic deformation which may be neutralized by deformation of either one of said means.

The lid 4 is provided, adjacent to one of the said free corners, and preferably, to the lower right hand corner according to what is illustrated in FIG. 1, with a pivot 8 raising perpendicularly to the plane of the lid 4 over a maximum height equal to that of the edge plate 7. The pivot 8 is formed by a cylindrical section coupled to a removable stop means 9 which may consist of a head of larger diameter mounted by pressure, screwing or other assembly means. The head 9 may also consist, as shown in FIG. 2, in a pin 10 provided with two resilient prongs 11 which are meant to be inserted into one of several diametrical holes 12 provided in the pivot 8. According to this particularly advantageous embodiment, it becomes possible to select the relative position of engagement of the pin 10 depending on the thickness of the deck of cards 13 to be stacked on the lid 4 between the tabs 6 and against the edge plate 7 which constitutes a stop means for the alignment of all the cards superimposed on the lid 4. In some cases, the aligning operation may be performed by the tab 6 corresponding to the small side of the lid 4 adjacent to which is situated the pivot 8. The aligning operation permits to place the different cards 13 in correct superimposed position on the pivot 8 and with respect to the lid 4 so as to allow, by relatively pivoting the latter in the direction of the arrow $f_1$, the closure of the casing and thus afford total protection to the cards.

In the open position such as shown in FIG. 1, it is possible with the pivot 8 to display in fan order, in the direction of arrow $f_2$, one or more of the cards 13 for consulting the information carried on the upper visible face and if necessary on the lower face after turning over the casing of the invention. Each card may thus be brought from the aforesaid aligned position to a fan-like pivoting position by rotation and partial display on the axis 8 such as in position $P_1$ or if required by a turn over into the position $P_2$ when the intention is to free completely the card immediately below with a view to having access to all the information carried thereon.

FIG. 3 shows that according to a variant embodiment, there is a possibility to place the pivot 8, not in the lower righthand corner of the lid 4 as shown in FIG. 1, but, on the contrary, in the top righthand corner so as to give a possibility to display the cards in fan order and to consult them by a relative pivoting movement in the direction of arrow $f_3$, that-is-to-say towards the top in reference to the position of use shown in FIG. 1. Such a variant embodiment, which consists only in altering the relative position of pivot 8, has the advantage of leaving completely free the lower small edge of the lid 4 and as a result, of giving a better access to the corresponding portions of cards 13 so that the display operation can be performed with the thumb of the right hand.

Another embodiment of the casing according to the constructive mode of FIGS. 1 and 3 is illustrated by FIGS. 4 and 5 which show that the geometrical pivoting axis X–X' is materialized by means of two extensions, studs or lugs 14, extending beyond the two smalls sides of the lid 4, so that they can be introduced in corresponding bearings defined by flanges 15 formed, at least in part, so as to project from the upper edge of the two small sides 3 of the box 1. Such an embodiment has the advantage of relatively elevating the lid 4 with respect to the box 1 and, as a result, of making the different cards 13 more accessible and easier to handle.

In this example of embodiment the alignment of all the cards 13 is ensured by stop means 16 being part of the lid 4 and formed adjacent the edge corresponding to the geometrical pivoting axis X–X', in such a way as to be placed inside the box 1 and parallel to the longitudinal side corresponding to the latter when the lid closes said box. FIG. 5 shows that with this variant embodiment it is possible to give each card a surface of use which is substantially equal to that of the lid 4, in view of the absence of the tabs 6 of the previous example, which represent an obstacle to the display, for the one diagonally opposite the pivot 5. Although not shown, it is obvious that in the embodiment according to FIGS. 4 and 5, the pivot 8 may be situated at the lower or upper righthand corner of the lid 4 in consideration of the way the consultation is effected (left or right hand).

FIG. 6 shows another embodiment of the object of the invention wherein the lid 4 is pivotally mounted on the box 1 by a geometrical axis X–X' which is situated in parallel to one of the small sides 3' of the box 1'. Just as in the example described in reference to FIG. 1, in such an embodiment, the box 1' has no small side corresponding to the geometrical pivoting axis X–X' when said axis is materialized by studs, lugs or other independent elements 5' passing through the end portions of the two parallel longitudinal sides 3' and of the tabs 6' arising from the lid 4'. The tab 6' which is diagonally opposed to pivot 8' is preferably provided with an extension 17 for the purpose of constituting a stop means for the alignment of the different cards, prior to closing the lid on the box 1'. FIG. 6 shows that the lid 4' may also be provided with en edge plate 7' extending from the small side of the said lid and connecting the tabs 6' together to reconstitute the periphery of the box 1' after the lid is closed.

The pivot 8' carried by the lid 4' is preferably situated in the lower righthand corner depending on the direction of the consultation, but it can also be situated in the lefthand corner in the same way as shown in FIG. 7.

A variant construction is illustrated by FIG. 8 which shows that it may also be advantageous to provide the small side of the lid 4' corresponding to the geometrical pivoting axis X–X' with studs, lugs or extensions 14' mounted in bearings defined by flanges 15' which are formed by the parallel longitudinal sides 3' of the box 1'. This arrangement offers of course the same advantages as those given in reference to FIGS. 4 and 5. In such a case, the lid 4' is provided with the lateral stop means 16' for aligning the cards 13.

As can be seen from the foregoing, the system according to the invention it is possible to ensure an efficient protection of the cards which may be easily filed on, or on the contrary removed from a joint stacking pivot carried by the pivoting lid, thus permitting an easy access to facilitate positioning, removing or filing of cards, as well as their successive stacking. The casing according to the invention also has an extremely simple structure which may be produced from fairly cheap moulds, thus permitting to arrive at a finished product of a low cost. Moreover, the opening of the lid 4, effected in the normal way of a lid on a conventional box, gives full access to the cards which then have a maximal space of use in which to be displayed partly or totally. This characteristic therefore affords rapid and handy consultation and the handling is particularly easy. Another advantage also resides in the embodiment shown in FIGS. 4 and 5, or even 8, whereby the deck of stacked cards may be placed in a plane which is elevated with respect to the box 1 thus improving even more the peripheral access to the cards when handling them or consulting them. A further advantage is related to the fact that when using the embodiment shown in FIG. 2 for the pivot 8, it is possible to mount in a box of given height a deck of cards of lesser thickness whilst holding the different cards in correct position without excessive clearance between their own planes.

The object of the invention may be applied to any group of cards carrying information and representing a collection, selections of samples for documentary, educational didactic and other purposes.

What is claimed is:

1. A casing for the protection and consultation of plane data carriers such as cards of the type comprising a box supporting, by means of a pivoting axis, a pivoting lid whose inner face with respect to the box is provided with a pivot on which are filed the cards which can be displayed in fan order or aligned with the lid to be placed inside the box when the said lid is brought into the position of closing the box, wherein the lid comprises, on the one hand, pivot situated adjacent one of the corner opposite the pivoting axis connecting the said lid to the box, and on the other hand, a projection acting as a stop means for the alignment of the said cards and, furthermore, an edge reconstituting at least partly the periphery of the casing when the said lid closes the box.

2. A casing as claimed in claim 1, wherein the projection forming a stop means for the alignment of the cards and the edge of the lid are formed by a single extension assuming both functions.

3. A casing as claimed in claim 1, wherein the lid is hinged on to the box so as to be extended substantially in the plane of the upper open section of the said box when the said lid is open.

4. A casing as claimed in claim 1 wherein the lid comprises a pivot provided with a removable head which is adjustable in the axial position.

5. A casing as claimed in claim 2, wherein the lid is hinged on to the box so as to be extended substantially in the plane of the upper open section of the said box when the said lid is open.

6. A casing as claimed in claim 2, wherein the lid comprises a pivot provided with a removable head which is adjustable in the axial position.

7. A casing as claimed in claim 3, wherein the lid comprises a pivot provided with a removable head which is adjustable in the axial position.

8. A casing as claimed in claim 5, wherein the lid comprises a pivot provided with a removable head which is adjustable in the axial position.

* * * * *

UNITED STATES PATENT AND TRADEMARK OFFICE

CERTIFICATE OF CORRECTION

PATENT NO. : 4,170,423

DATED : October 9, 1979

INVENTOR(S) : Jean Bourbon

It is certified that error appears in the above-identified patent and that said Letters Patent are hereby corrected as shown below:

PLEASE CHANGE ASSIGNEE, Societe Anonyme: Tournerie du Jura-Ets A. Bourbon & Fils, France

TO

--ASSIGNEES: Societe Anonyme: Tournerie du Jura-Ets A. Bourbon & Fils, France and Societe Anonyme: Dargaud Editeur, a part interest each --.

Signed and Sealed this

Sixteenth Day of December 1980

[SEAL]

Attest:

SIDNEY A. DIAMOND

Attesting Officer

Commissioner of Patents and Trademarks